US006347879B1

(12) United States Patent
Prado

(10) Patent No.: US 6,347,879 B1
(45) Date of Patent: Feb. 19, 2002

(54) VOTIVE CANDLE CUP TO OIL LAMP CONVERTER KIT

(76) Inventor: Heidi A. Prado, 251 Hilltop Dr., #149, Redding, CA (US) 96003

( * ) Notice: Subject to any disclaimer, the term of this patent is extended or adjusted under 35 U.S.C. 154(b) by 0 days.

(21) Appl. No.: 09/271,846

(22) Filed: Mar. 18, 1999

(51) Int. Cl.[7] ..... F21L 19/00

(52) U.S. Cl. ..... 362/159; 362/157; 362/161; 431/304; 431/306; 431/320; 431/321

(58) Field of Search ..... 362/157–160, 362/161–163; 431/301, 298, 302, 304, 306, 320, 319, 321

(56) References Cited

U.S. PATENT DOCUMENTS 664,167 A * 12/1900 Moegling ..... 431/320
3,790,332 A * 2/1974 Woollard ..... 431/126
5,669,767 A * 9/1997 Bureau et al. ..... 431/320

* cited by examiner

*Primary Examiner*—Sandra O'Shea
*Assistant Examiner*—Ismael Negron

(57) ABSTRACT

A votive cap converter kit for converting a votive candle cup into an oil burning candle. The votive cap converter kit includes an elongate tubular sheath with a wick extending through the sheath such that an upper end of the wick outwardly extends from a top end of the sheath and a lower end of the wick outwardly extends from a bottom end of the sheath. A support plate is also included with a wick hole therethrough through which the sheath may be inserted. The support plate is designed for insertion into a container has lamp oil fluid therein such that the bottom end of the sheath is submerged in the lamp oil fluid and the support plate and the top end of the sheath are positioned in the container above the lamp oil fluid.

8 Claims, 3 Drawing Sheets

VOTIVE CANDLE CUP TO OIL LAMP CONVERTER KIT

BACKGROUND OF THE INVENTION

1. Field of the Invention

The present invention relates to votive cap converter kit and more particularly pertains to a new votive cap converter kit for converting a votive candle cup into to oil lamp converter kit an oil burning candle.

2. Description of the Prior Art

The use of votive cap converter kit is known in the prior art. More specifically, votive cap converter kit heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 3,183,688; 4,019,856; 5,086,380; 3,583,853; 4,511,952; and U.S. Pat. No. Des. 318,927.

While these devices fulfill their respective, particular objectives and requirements, the aforementioned patents do not disclose a new votive cap converter kit. The inventive device includes an elongate tubular sheath with a wick extending through the sheath such that an upper end of the wick outwardly extends from a top end of the sheath and a lower end of the wick outwardly extends from a bottom end of the sheath. A support plate is also included with a wick hole therethrough through which the sheath may being inserted. The support plate is designed for insertion into a container has lamp oil fluid therein such that the bottom end of the sheath is submerged in the lamp oil fluid and the support plate and the top end of the sheath are positioned in the container above the lamp oil fluid.

In these respects, the votive cap converter kit according to the present invention substantially departs from the conventional concepts and designs of the prior art, and in so doing provides an apparatus primarily developed for the purpose of converting a votive candle cup into an oil burning candle.

SUMMARY OF THE INVENTION

In view of the foregoing disadvantages inherent in the known types of votive cap converter kit now present in the prior art, the present invention provides a new votive cap converter kit construction wherein the same can be utilized for converting a votive candle cup into an oil burning candle.

The general purpose of the present invention, which will be described subsequently in greater detail, is to provide a new votive cap converter kit apparatus and method which has many of the advantages of the votive cap converter kit mentioned heretofore and many novel features that result in a new votive cap converter kit which is not anticipated, rendered obvious, suggested, or even implied by any of the prior art votive cap converter kit, either alone or in any combination thereof.

To attain this, the present invention generally comprises an elongate tubular sheath with a wick extending through the sheath such that an upper end of the wick outwardly extends from a top end of the sheath and a lower end of the wick outwardly extends from a bottom end of the sheath. A support plate is also included with a wick hole therethrough through which the sheath may being inserted. The support plate is designed for insertion into a container has lamp oil fluid therein such that the bottom end of the sheath is submerged in the lamp oil fluid and the support plate and the top end of the sheath are positioned in the container above the lamp oil fluid.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new votive cap converter kit apparatus and method which has many of the advantages of the votive cap converter kit mentioned heretofore and many novel features that result in a new votive cap converter kit which is not anticipated, rendered obvious, suggested, or even implied by any of the prior art votive cap converter kit, either alone or in any combination thereof.

It is another object of the present invention to provide a new votive cap converter kit which may be easily and efficiently manufactured and marketed.

It is a further object of the present invention to provide a new votive cap converter kit which is of a durable and reliable construction.

An even further object of the present invention is to provide a new votive cap converter kit which is susceptible of a low cost of manufacture with regard to both materials and labor, and which accordingly is then susceptible of low prices of sale to the consuming public, thereby making such votive cap converter kit economically available to the buying public.

Still yet another object of the present invention is to provide a new votive cap converter kit which provides in the apparatuses and methods of the prior art some of the advantages thereof, while simultaneously overcoming some of the disadvantages normally associated therewith.

Still another object of the present invention is to provide a new votive cap converter kit for converting a votive candle cup into an oil burning candle.

Yet another object of the present invention is to provide a new votive cap converter kit which includes an elongate tubular sheath with a wick extending through the sheath such that an upper end of the wick outwardly extends from a top end of the sheath and a lower end of the wick outwardly extends from a bottom end of the sheath. A support plate is also included with a wick hole therethrough through which the sheath may being inserted. The support plate is designed for insertion into a container has lamp oil fluid therein such that the bottom end of the sheath is submerged in the lamp oil fluid and the support plate and the top end of the sheath are positioned in the container above the lamp oil fluid.

Still yet another object of the present invention is to provide a new votive cap converter kit that may be used to convert various containers, such as vases, wine glasses, and juice glasses, into oil burning candles.

Even still another object of the present invention is to provide a new votive cap converter kit that may have various designs and decorations thereon for added beauty to the completed oil candle.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
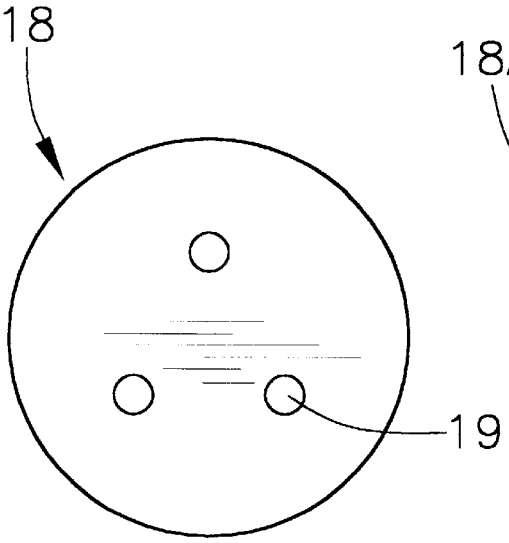
FIG. 1 is a schematic top view of a circular support plate with three wick holes.
Figure 2:
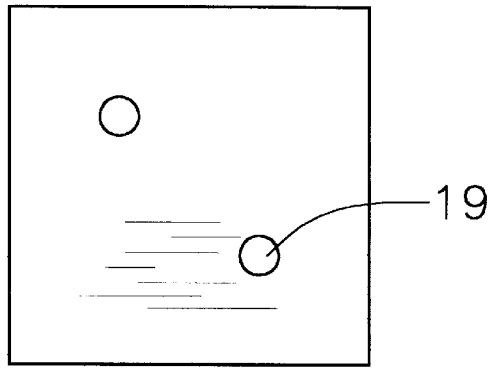
FIG. 2 is a schematic top view of a square support plate having two wick holes.

With reference now to the drawings, and in particular to FIGS. 1 through 8 thereof, a new votive cap converter kit embodying the principles and concepts of the present invention will be described.

As best illustrated in FIGS. 1 through 8, the votive cap converter kit 10 generally comprises an elongate tubular sheath with a wick extending through the sheath such that an upper end of the wick outwardly extends from a top end of the sheath and a lower end of the wick outwardly extends from a bottom end of the sheath. A support plate is also included with a wick hole therethrough through which the sheath may being inserted. The support plate is designed for insertion into a container has lamp oil fluid therein such that the bottom end of the sheath is submerged in the lamp oil fluid and the support plate and the top end of the sheath are positioned in the container above the lamp oil fluid.

In closer detail, the kit comprises an elongate tubular sheath 10 with open top and bottom ends 11,12, and a longitudinal axis extending between the top and bottom ends of the sheath. Preferably, the sheath comprising a glass material. Also preferably, the sheath is generally cylindrical such that the sheath has a generally circular transverse cross section taken substantially perpendicular to the longitudinal axis of the sheath.

The sheath has an outwardly radiating upper butt 13 adjacent the top end of the sheath. The sheath and the upper butt each have an outer diameter defined substantially perpendicular to the longitudinal axis of the sheath. The diameter of the upper butt is greater than the diameter of the sheath.

A flammable flexible wick 14 is extended through the lumen of the sheath such that an upper end 15 of the wick outwardly extends from the top end of the sheath and a lower end 16 of the wick outwardly extends from the bottom end of the sheath. The wick comprises a material capable of transporting lamp oil by capillary action from the lower end of the wick to the upper end of the wick which may be ignited to form a flame 17.

The kit also includes a support plate 18 with top and bottom faces, and an outer perimeter. The support plate has at least one generally circular wick hole 19 therethrough. It should be understood that the support plate may have one, two, three or even more wick holes as desired. The wick hole of the support plate has a diameter greater than the diameter of the sheath and less than the diameter of the upper butt.

Figure 6:
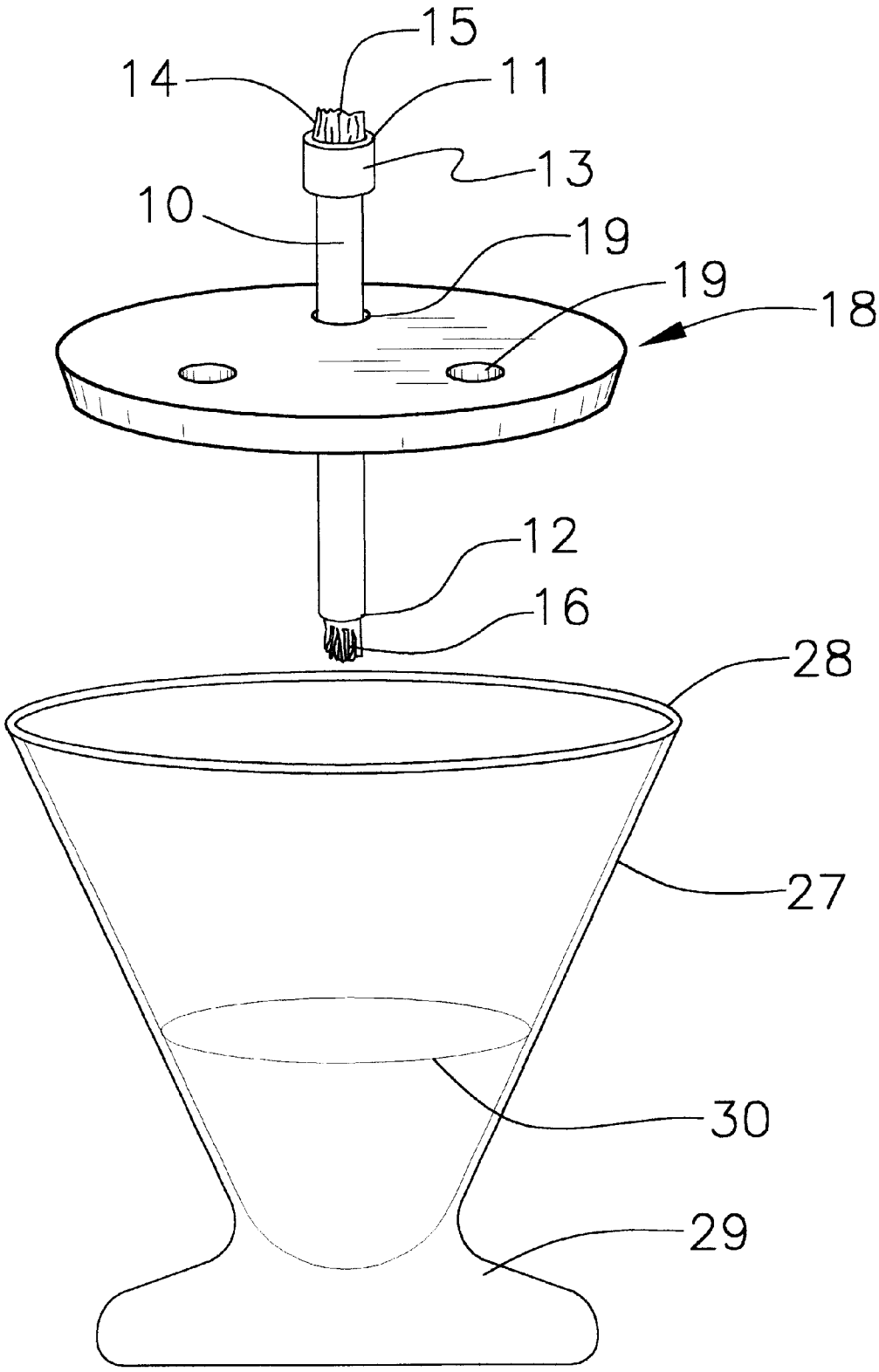
FIG. 6 is a schematic exploded perspective view of the present invention with a container holding lamp oil fluid therein.
Figure 7:
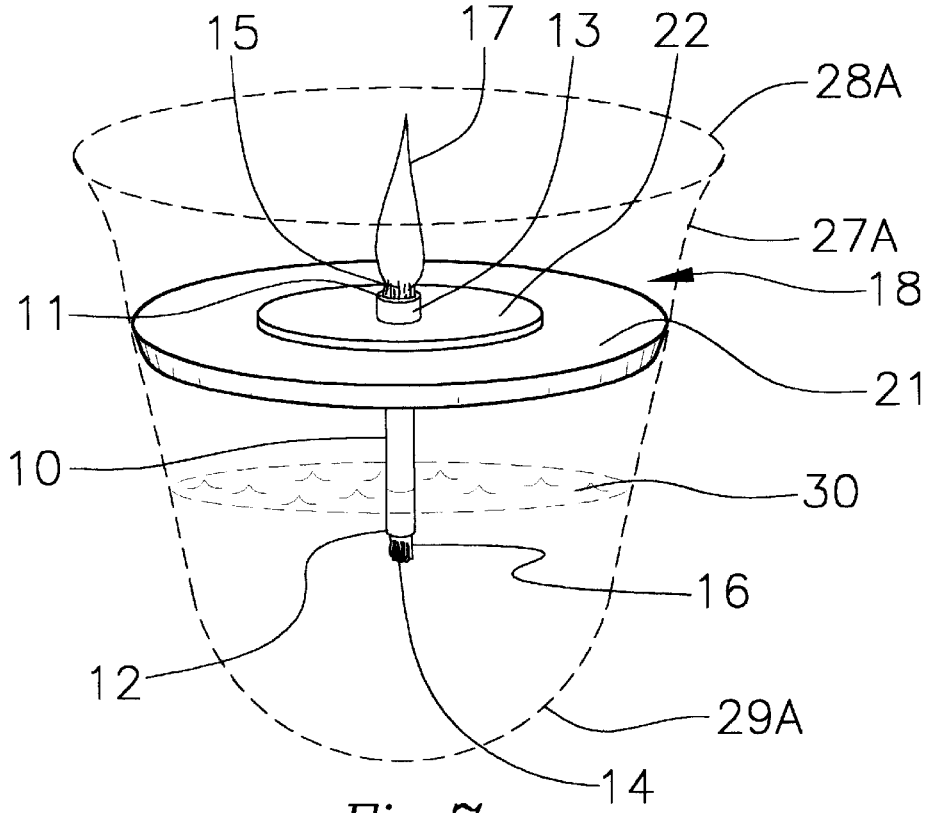
FIG. 7 is a schematic perspective view of an embodiment of the present invention having a support plate with two annular portions in use.

As best illustrated in FIGS. 6 and 7, the sheath is inserted into the wick hole such that the top end of the sheath is outwardly extended from the top face of the support plate and the bottom end of the sheath is outwardly extended from the bottom face of the support plate. The upper butt of the sheath abuts the top face of the support plate.

Figure 3:
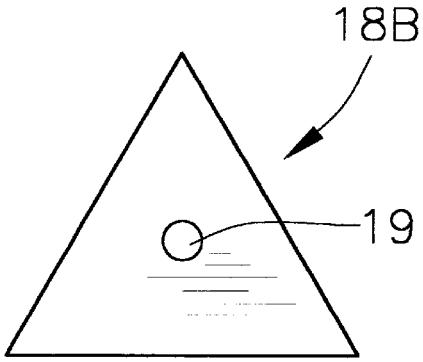
FIG. 3 is a schematic top view of a triangular support plate with one wick hole.
Figure 4:
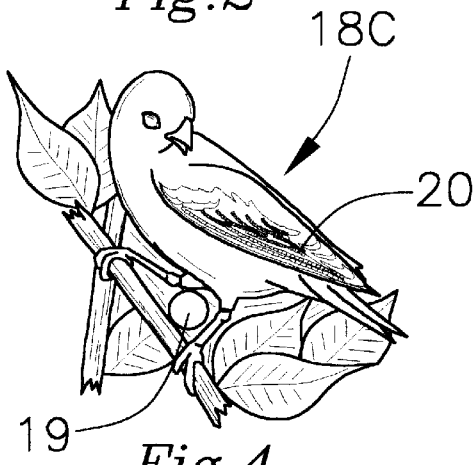
FIG. 4 is a schematic top view of a decorative support plate with one wick hole.
Figure 5:
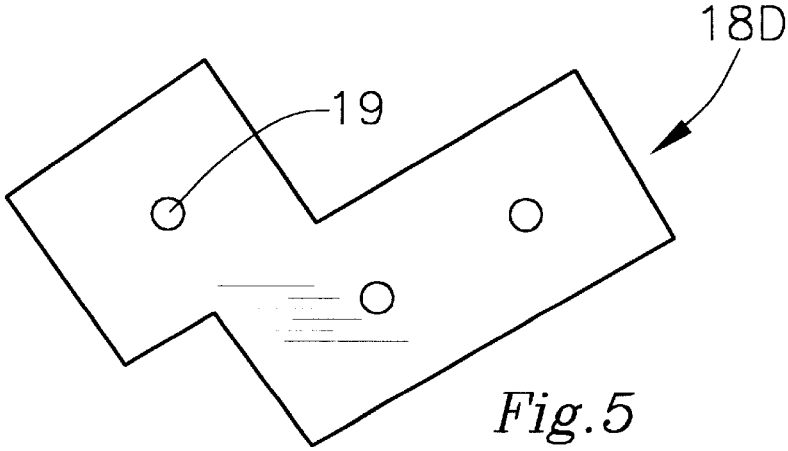
FIG. 5 is a schematic top view of a polyhedral support plate with three wick holes.

The outer perimeter of the support plate may be any shape. With reference to FIGS. 1, 6, 7, and 8, the outer perimeter of the support plate may be generally circular in shape. Also preferably, the outer perimeter of the support plate 18A may be generally rectangular or square in shape as shown in 2. In a third preferred embodiment, the outer perimeter of the support plate 18B may be generally triangular in shape as illustrated in FIG. 3. With reference to FIG. 4, the outer perimeter of the support plate 18C may even be shaped to resemble an outline of a decorative image with the top face 20 of the support plate having a design thereon corresponding to the outline of the outer perimeter of the support plate. As illustrated in FIG. 5, the outer perimeter of the support plate 18D may even have seven sides with each side extended at a right angle to the two adjacent sides of the outer perimeter.

Optionally, the top face of the support plate may comprise a mirrored surface for reflecting a substantial amount of light striking the top face of the support plate.

Figure 8:
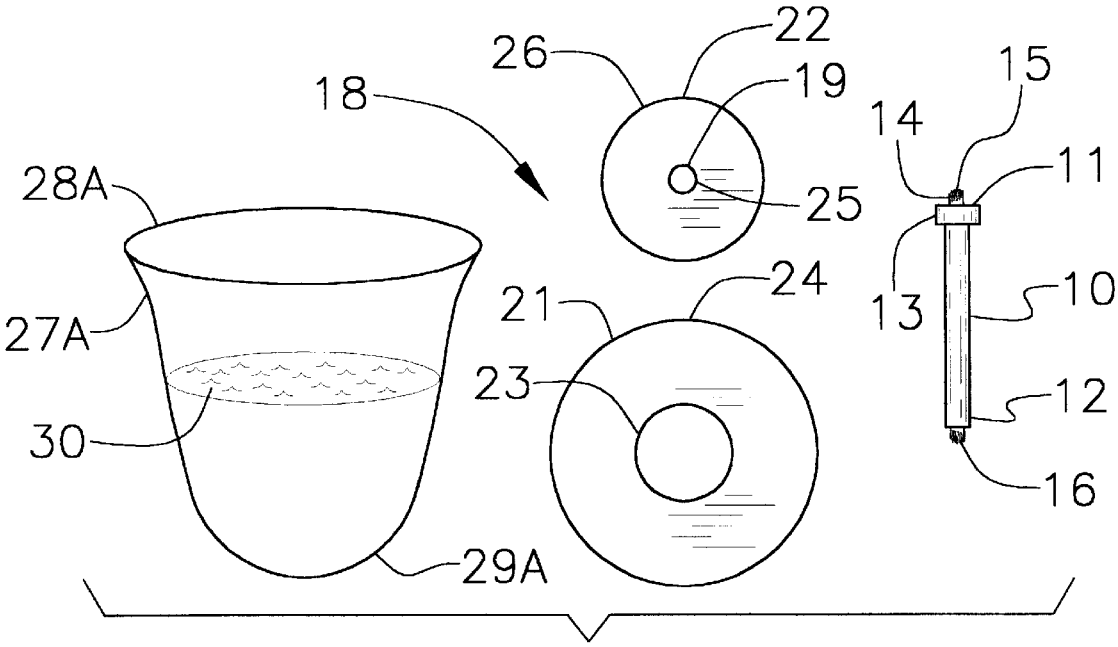
FIG. 8 is a schematic plan view of the embodiment present invention of FIG. 7 in a disassembled state.

With reference to FIGS. 7 and 8, in another preferred embodiment, the support plate may comprises at least two separable concentric annular portions 21,22. The outer annular portion 21 of the annular portions of the support plate has a generally circular inner perimeter 23 with the outer perimeter of the support plate defining an outer perimeter 24 of the outer annular portion. The inner annular portion 22 of the annular portions support has inner and outer perimeters 25,26. In this preferred embodiment, the wick hole of the support plate is preferably located in sad inner annular portion.

The outer perimeter of the inner annular portion has a diameter greater than a diameter of the inner perimeter of the outer annular portion. As best illustrated in FIG. 7, the inner annular portion is positioned over the hole defined by the inner perimeter of the outer annular portion and is rested on the outer annular portion.

A container 27 such as a votive candle cup is also needed having an open top 28, a bottom 29, and a downwards taper such that a first diameter of the container towards the open top is greater than a second diameter of the container towards the bottom of the container. The container defines a reservoir for holding a lamp oil fluid 30 therein. In use, the support plate is disposed in the container such that the top end of the sheath upwardly extends from the support plate and the bottom end of the sheath is submerged in the lamp oil fluid in the container. The diameter of the outer perimeter of the support plate is less than the first diameter of the container and greater than the second diameter of the container such that the outer perimeter of the support plate engages (that is abuts) an interior surface of the container to hold the support plate and the top end of the sheath above the lamp oil fluid in the container.

In another preferred embodiment, such as in FIGS. 7 and 8, the container 27A also contains an open top 28A and a bottom 29A.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A kit having component parts capable of being assembled comprising:

a burning assembly comprising:

an elongate tubular sheath having open top and bottom ends, and a longitudinal axis extending between said top and bottom ends of said sheath, said sheath having a diameter;

a wick being extended through said sheath such that an upper end of said wick outwardly extends from said top end of said sheath and a lower end of said wick outwardly extends from said bottom end of said sheath;

a support plate having top and bottom faces, and an outer perimeter;

said support plate having a wick hole therethrough;

said sheath of said burning assembly being adapted for insertion into said wick hole;

said support plate being adapted for insertion into a container having lamp oil fluid therein such that said bottom end of said sheath is submerged in said lamp oil fluid and said support plate and said top end of said sheath are positioned in the container above the lamp oil fluids;

said container having an open top, a bottom, and a downwards taper such that a first diameter of said container towards said open top is greater than a second diameter of said container towards said bottom of said container, said container defining a reservoir having a lamp oil fluid therein; and said support plate having a diameter that is less than said first diameter of the container and greater than said second diameter of said container;

wherein said support plate comprises at least two separable concentric annular portions, an outer annular portion of said annular portions of said support plate having said outer perimeter of said support plate defining an outer perimeter of said outer annular portion, said outer annular portion having a generally circular inner perimeter, an inner annular portion of said annular portions support having inner and outer perimeters;

wherein said outer perimeter of said inner annular portion has a diameter greater than a diameter of said inner perimeter of said outer annular portion, said inner annular portion being positioned over a hole defined by said inner perimeter of said outer annular portion and being rested on said outer annular portion;

wherein said inner perimeter of said inner annular portion having a diameter substantially equal to said diameter of said sheath, said inner perimeter of said outer annular portion being larger than said diameter of said sheath such that said sheath is laterally shiftable in said hole in said outer annular portion with the inner annular portion.

2. The kit of claim 1, wherein said sheath comprises a glass material.

3. The kit of claim 1, wherein said outer perimeter of said support plate is generally circular in shape.

4. The kit of claim 1, wherein said top face of said support plate comprises a mirrored surface for reflecting a substantial amount of light striking said top face of said support plate.

5. The kit of claim 1, wherein a diameter of the hole of said inner perimeter of said outer annular portion is approximately twice said diameter of said sheath for permitting lateral shifting of said sheath in said hole of said inner perimeter of said outer annular sheath.

6. A kit having component parts capable of being assembled comprising:

a container having an open top and a bottom, said container having an interior with a first interior dimension of said container towards said open top being greater than a second interior dimension of said container, said container defining a reservoir for receiving a lamp oil fluid therein;

a burning assembly comprising:

an elongate tubular sheath having open top and bottom ends, and a longitudinal axis extending between said top and bottom ends of said sheath, said sheath having a diameter;

a wick for inserting through said sheath such that an upper end of said wick is outwardly extendable from said top end of said sheath and a lower end of said wick is outwardly extendable from said bottom end of said sheath; and a support plate having top and bottom faces, and an outer perimeter;

said support plate having a wick hole therethrough;

said sheath of said burning assembly being removably insertable into said wick hole;

said support plate being adapted for insertion into a container having lamp oil fluid therein such that said bottom end of said sheath is submergable in said lamp oil fluid and said support plate and said top end of said sheath are positionable in the container above the lamp oil fluid;

said support plate having a diameter that is less than said first interior dimension of the container and greater than said second interior dimension of said container such that said support plate is lodgable in the interior of said container above the bottom of said container;

wherein said support plate comprises at least two separable concentric annular portions, an outer annular portion of said annular portions of said support plate having said outer perimeter of said support plate defining an outer perimeter of said outer annular portion, said outer annular portion having a generally circular inner perimeter, an inner annular portion of said annular portions support having inner and outer perimeters;

wherein said outer perimeter of said inner annular portion has a diameter greater than a diameter of said inner perimeter of said outer annular portion, said inner annular portion being positioned over a hole defined by said inner perimeter of said outer annular portion and being rested on said outer annular portion;

wherein said inner perimeter of said inner annular portion having a diameter substantially equal to said diameter of said sheath, said inner perimeter of said outer annular portion being larger than said diameter of said sheath such that said sheath is laterally shiftable in said hole in said outer annular portion with the inner annular portion.

7. The kit of claim 6, wherein a diameter of the hole of said inner perimeter of said outer annular portion is approximately twice said diameter of said sheath for permitting lateral shifting of said sheath in said hole of said inner perimeter of said outer annular sheath.

8. In combination:

at least two burning assemblies, each of said burning assemblies comprising:

an elongate tubular sheath having open top and bottom ends, and a longitudinal axis extending between said top and bottom ends of said sheath;

said sheath comprising a glass material;

said sheath having a generally circular transverse cross section taken substantially perpendicular to said longitudinal axis of said sheath;

said sheath having an outwardly radiating upper butt adjacent said top end of said sheath;

said sheath and said upper butt each having an outer diameter defined substantially perpendicular to said longitudinal axis of said sheath;

said diameter of said upper butt being greater than said diameter of said sheath;

a flexible wick being extended through said sheath such that an upper end of said wick outwardly extends from said top end of said sheath and a lower end of said wick outwardly extends from said bottom end of said sheath;

a support plate having top and bottom faces, and an outer perimeter;

said support plate having at least two generally circular wick holes therethrough for each receiving one of said burning assemblies, said wick holes of said support plate having a diameter greater than said diameter of said sheath and less than said diameter of said upper butt;

said sheath of each of said burning assemblies being inserted into one of said wick holes such that said top end of said sheath is outwardly extended from said top face of said support plate and said bottom end of said sheath is outwardly extended from said bottom face of said support plate;

said upper butt of said sheath of each said burning assembly abutting said top face of said support plate;

wherein said support plate comprises at least two separable concentric annular portions, an outer annular portion of said annular portions of said support plate having said outer perimeter of said support plate defining an outer perimeter of said outer annular portion, said outer annular portion having a generally circular inner perimeter, an inner annular portion of said annular portions support having inner and outer perimeters;

wherein said outer perimeter of said inner annular portion has a diameter greater than a diameter of said inner perimeter of said outer annular portion, said inner annular portion being positioned over a hole defined by said inner perimeter of said outer annular portion and being rested on said outer annular portion;

wherein said inner perimeter of said inner annular portion having a diameter substantially equal to said diameter of said sheath, said inner perimeter of said outer annular portion being larger than said diameter of said sheath such that said sheath is laterally shiftable in said hole in said outer annular portion with the inner annular portion;

a container having an open top, a bottom, and a downwards taper such that a first diameter of said container towards said open top is greater than a second diameter of said container towards said bottom of said container;

said container defining a reservoir having a lamp oil fluid therein;

said support plate being disposed in said container such that said top end of said sheath upwardly extends from said support plate and said bottom end of said sheath is submerged in said lamp oil fluid in said container; and said diameter of said outer perimeter of said support plate being less than said first diameter of said container and greater than said second diameter of said container such that said outer perimeter of said support plate engages an interior surface of said container to hold said support plate and said top end of said sheath above the lamp oil fluid in the container.

* * * * *